US005161552A

United States Patent [19]

Kathuria

[11] Patent Number: 5,161,552

[45] Date of Patent: Nov. 10, 1992

[54] NAIL FILER

[76] Inventor: Mineshwar K. Kathuria, 778 E. Main St., Torrington, Conn. 06790

[21] Appl. No.: 783,322

[22] Filed: Oct. 28, 1991

[51] Int. Cl.[5] ..... A45D 29/05

[52] U.S. Cl. ..... 132/73.6; 132/75.6; 132/75.8

[58] Field of Search ..... 132/73.6, 75, 75.3, 132/75.6, 75.8

[56] References Cited

U.S. PATENT DOCUMENTS

| | | | |
|---|---|---|---|
| 1,915,305 | 6/1933 | Gallagher | 132/75.8 |
| 2,056,379 | 10/1936 | Acocella | 132/73.6 |
| 2,923,303 | 2/1960 | Hundt | 132/75.8 |
| 3,216,034 | 11/1965 | Johnson | 132/73.6 |
| 3,311,117 | 3/1967 | Thompson | 132/73.6 |
| 3,587,596 | 6/1971 | Wolff | 132/73.6 |
| 3,596,667 | 8/1971 | Buercklin et al. | 132/73.6 |
| 4,117,854 | 10/1978 | Rosenbloom | 132/75.8 |
| 4,753,253 | 6/1988 | Hutson | 132/73.6 |
| 4,896,684 | 1/1990 | Chou | 132/75.6 |

FOREIGN PATENT DOCUMENTS

| | | | |
|---|---|---|---|
| 1457442 | 3/1969 | Fed. Rep. of Germany | 132/73.6 |
| 3207456 | 9/1983 | Fed. Rep. of Germany | 132/73.6 |
| 3400375 | 7/1985 | Fed. Rep. of Germany | 132/73.6 |
| 1355632 | 2/1964 | France | 132/73.6 |

*Primary Examiner*—Gene Mancene
*Assistant Examiner*—Frank A. LaViola
*Attorney, Agent, or Firm*—Dallett Hoopes

[57] ABSTRACT

A nail filer comprises a generally cylindrical housing containing an electric motor and a power source, preferably dry cell batteries. The housing may have an on-off switch and a safety switch. Connected to the motor outside the housing is the end of a filing drum of different degees of roughness in segments therealong. A cover, which is essentially cup-shaped, fits over the drum and its end provides a bearing for the distal end of the drum. The cover is of irregular wall shape so that its exterior is oblong. Peripheral slots are formed in the cover to space the finger from the drum so that the sides of the nail may be filed off closer than the center tip of the nail. In a preferred embodiment the drum is formed with valleys, also roughened, and additional slots in the cover align with the valleys for the purpose of filing nails of longer length, using the cover again as a variable spacer.

3 Claims, 1 Drawing Sheet

NAIL FILER

BACKGROUND OF THE INVENTION

1. Field of the Invention

This invention relates to electric rotary nail files. More specifically, this invention relates to a pocket-carried electric nail file having means for spacing the finger from the filer to get the desired length and shape of nail.

2. Description of Related Art including Information Disclosed under §§1.97 to 1.99

The prior art is replete with electric nail filers of the rotary type. An example is the U.S. Pat. No. 2,056,379 which issued Oct. 6, 1936 to P. F. Acocella and discloses a rotary nail filer having an elongated tubular casing with windows which give access to rotating drums inside the casing. The finger may be placed adjacent the windows with the nail protruding inside so that the drum, as it rotates, files off the front of the nail.

The U.S. Pat. No. 2,923,303 which issued Feb. 2, 1960 to F. J. Hundt discloses a powered finger nail file in which an adjustable guide may be set adjacent a rotary sanding head, the guide adapted to space the finger away from the head in a way which controls the length of the finished nail.

The more recent U.S. Pat. No. 4,753,253 which issued Jun. 28, 1988 to H. A. Hutson provides a belt-driven sanding wheel, the periphery of which is accessible through a slot in the side of the filer case and the curvature of the housing in the area of the slot sets the length of nail which may be brought against the wheel.

SUMMARY OF THE INVENTION

In the present invention the filer comprises a generally cylindrical housing containing an electric motor and, preferably, dry cell batteries. Connected to the motor is a filing drum of different degrees of roughness in segments therealong. A cover, which is essentially cup-shaped, fits over the drum and its end provides a bearing for the distal end of the drum. The cover, which fits on the end of the housing, is of irregular wall shape so that its exterior is oblong, slots being formed in the wall to space the finger from the drum so that the sides of the nail may be filed off closer than the center tip of the nail. In a preferred embodiment the drum is formed with valleys, also roughened, and additional slots in the cover align with the valleys for the purpose of filing nails of longer length, using the cover again as a variable spacer.

BRIEF DESCRIPTION OF THE DRAWINGS

Other objects and features of the invention will be apparent from a reading of the following specification and reference to the drawings, all of which show non-limiting embodiments. In the drawings.

DESCRIPTION OF THE PREFERRED EMBODIMENTS

Figure 1:
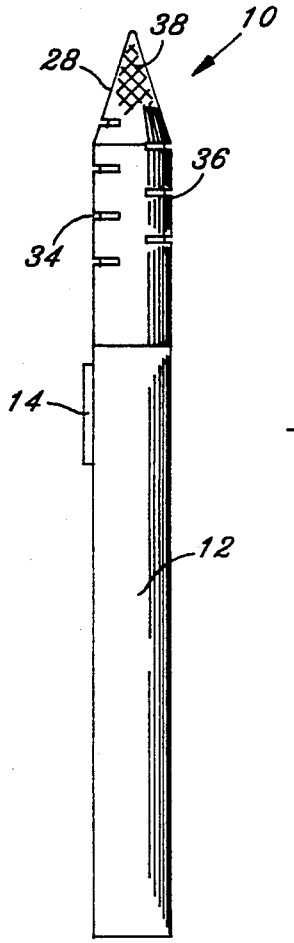
FIG. 1 is a side elevation of a filer embodying the invention.
Figure 2:
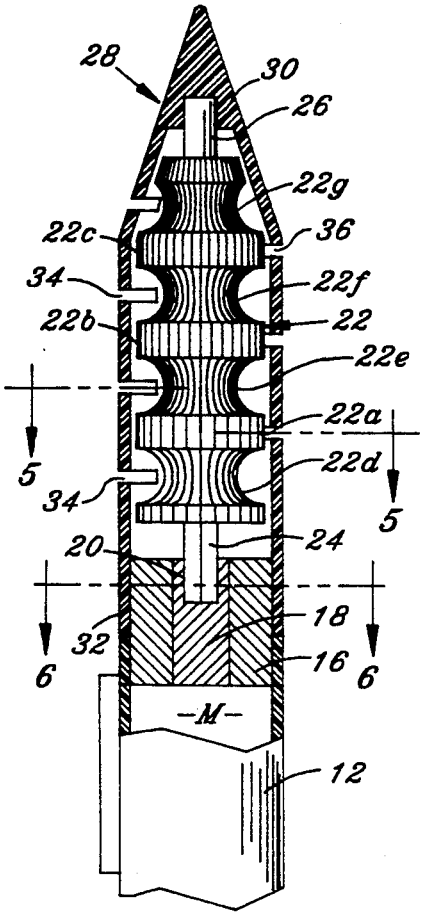
FIG. 2 is an enlarged fragmentary view with part of the cover removed to expose the valleyed drum of the preferred embodiment.

A nail filer embodying the invention is generally designated 10 in FIG. 1. It comprises a generally cylindrical housing 12 which may be of plastic and cup-shaped and preferably contains in series a pair of dry cell batteries (not shown) and an electric motor M (FIG. 2). Alternatively, the power source may be a connection to an external source through a cord or the like (not shown). A flashlight-type slide switch 14 is used to control the motor in a manner well known in the art.

Referring further to FIG. 2, in the top end of the housing is a cylindrical plug 16 which is held in position by means not shown. Plug 16, which is preferably of brass, has a central opening in which rotates a coupling head 18 operatively attached to the motor M so that it rotates within the plug 16 when the motor is on. The upper end of the head 18 has a female coupling recess 20 which is preferably square in cross section for reasons which will appear. At the side of this plug 16 may be a safety switch 21 which will prevent the motor from operation if cover is off.

A filing drum 22 (FIG. 2) is provided having segments 22*a*, 22*b* and 22*c* of the same diameter which are spaced from each other and of different degrees of coarseness, the most coarse being preferably toward the lower end at 22*a*. The drum is formed with a square shank 24 which is received into the square recess 20 in the coupling head to rotatably connect the two elements.

Adjacent and intermediate the segments 22*a, b* and *c*, already described, there are provided valley segments 22*d*, 22*e*, 22*f* and 22*g*. These segments are finished with the same degree of coarseness as the respective segment 22*a, b* or *c* immediately thereabove, the upper valley 22*g* being even finer than segment 22*c*. The upper end of the drum 22 is formed with a cylindrical spindle shaft 26.

Figure 6:
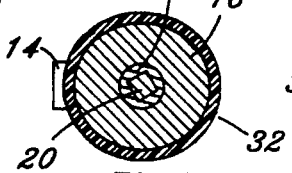
FIG. 6 is a sectional view taken on the line 6—6 of FIG. 2.

A cup-shaped cover 28 is provided and is formed in its upper end with a bearing recess 30. At its lower end 32 the cover is sized to be friction-fitted onto the upper end of the plug 16 and in the process depresses safety switch 21 to enable motor M to be turned on by the slide switch 14. The cover 28 and the housing 12, as well as plug 16, are preferably oblong in cross-sectional shape (FIG. 6) for reasons which will appear.

In assembly, as shown in FIG. 2, the square shank 24 of the drum is fitted into the head 18. The cover 28 is then brought over the drum so that its lower end 32 slips down over the plug 16 until the end butts against the top of the housing 12 and in process depresses safety switch 21. Simultaneously, the drum shaft 26 fits into recess 30.

The cover is formed with slots (FIG. 1) More specifically, on one side of the cover 28 slots 34 are formed so that in assembly they align with the valleys 22*d, e, f* and

*g*. On the other side the cover is formed with slots 36 which align with the surfaces 22*a, b* and *c*.

Figure 5:
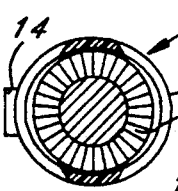
FIG. 5 is a sectional view taken on the line 5—5 of FIG. 2.
Figure 7:
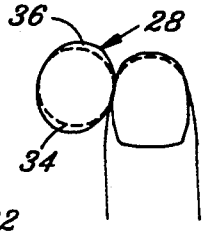
FIG. 7 is a simplified view showing filing the sides of the nail and using the configuration of the cover to advantage.
Figure 8:
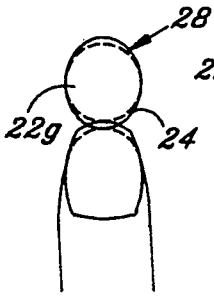
FIG. 8 is a simplified view showing the filing of the point of a nail also using the configuration of the cover to advantage.

An important feature of the invention is that the cover is configured so that at the slots the shape of the cover serves as spacing means for the nail being filed. In other words, and with reference to FIG. 5, the cover 28, has its exterior in the areas of the slots bulging outward towards the center of the slots 34, 36 so that, as shown in FIGS. 7 and 8, the nail may be brought around through the slot, pivoted in a way that the center of the nail is aligned radially with the center of the slot. In this fashion, the nail is formed with an attractive rounded configuration, the center of the nail being longer than the sides. For this purpose the ends of the slots may be feathered as shown in FIG. 5, enabling the side of the nail to get close to the drum.

Figure 9:
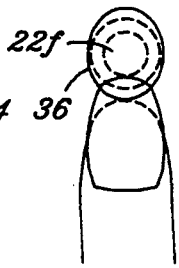
FIG. 9 is a simplified view showing the filing of a nail of longer length.

The FIGS. 7 and 8 demonstrate how filing takes place through the slots 36. FIG. 9 shows the oblong configuration of the exterior of the cover being used to advantage for the filing of a longer nail as the center nail is brought against the valley 22*f* through the aligned opening 34.

Figure 3:
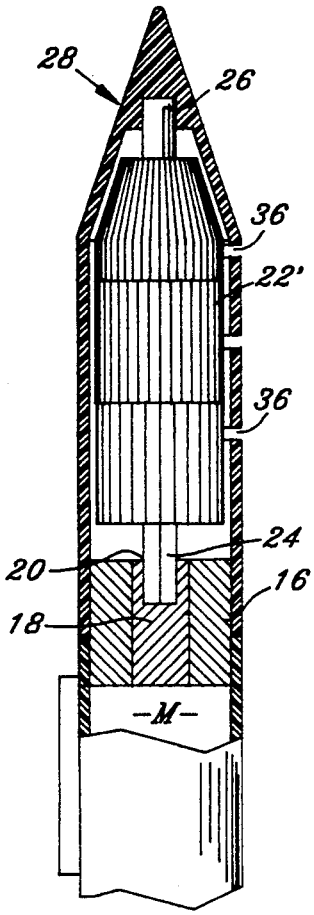
FIG. 3 is similar to FIG. 2 showing a drum without any valleys.
Figure 4:
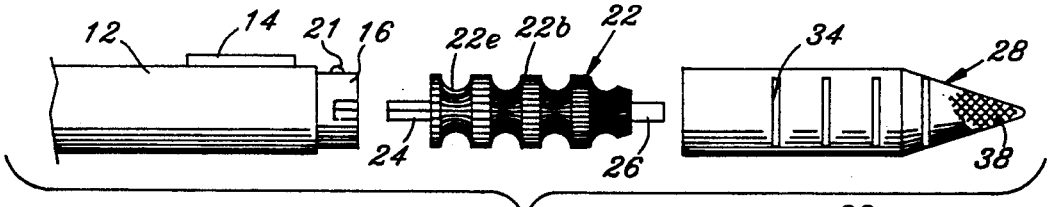
FIG. 4 is an exploded view showing the cover removed and the drum uncoupled from the housing as it would be for cleaning or replacement.

The FIG. 3 version of the invention presents a drum having a generally cylindrical configuration with a segmented drum 22′ having segments of different degrees of coarseness aligned with the different slots 36.

The upper end of the cover 28 may be tapered preferably to a kind of rounded point. Its periphery may be roughened at 38 as by knurling (FIG. 1) or the like to serve as a file as might be used in finishing around a cuticle or under the edge of the side of a nail.

Variations of the embodiments disclosed are possible without departing from the spirit of the invention. Thus, while the invention has been shown in only limited embodiments, it is not so limited but is of a scope defined by the following claim language which may be broadened by an extension of the right to exclude others from making or using the invention as is appropriate under the doctrine of equivalents.

What is claimed is:

1. An elongate, slender electric rotary nail filer comprising:

(a) a cylindrical housing containing an electric motor presenting a driver half coupling at one end of the housing and means to supply electric power to the motor, (b) a cylindrical filing drum having at one end a driven half coupling, the driven half coupling removably connecting with the driver half coupling, the drum having at the other end a spindle shaft, the drum being longitudinally segmented into different coarseness of filing surfaces, and (c) a cup-shaped cover fitting closely over the drum and engaging the housing while permitting rotation of the drum and releasably engaging said one end of the housing, the cover having longitudinally spaced partial peripheral slots providing a nail access to the different segments of the drum, and a drum-shaft-receiving bearing at the inside of the end of the cover, the drum intermediate the segments being formed with annular valleys of various coarsenesses and some of the slots line up with the valleys whereby filing of a longer nail may be possible using the cover as a spacer.

2. An electric rotary nail filer as claimed in claim 1 wherein the cover has a pointed closed end, the closed end having a roughened outer surface for manual filing.

3. An electric rotary nail filer as claimed in claim 1 wherein the means to supply electric power comprises a cylindrical dry cell battery in the housing.

* * * * *